US005817245A

United States Patent [19]

Iwamoto et al.

[11] Patent Number: 5,817,245

[45] Date of Patent: Oct. 6, 1998

[54] METHOD OF AND APPARATUS FOR TRIBOCHEMICALLY FINISHING CERAMIC WORKPIECE

[75] Inventors: Jun Iwamoto; Yasuhiko Jinbu, both of Wako, Japan

[73] Assignee: Honda Giken Kogyo Kabushiki Kaisha, Tokyo, Japan

[21] Appl. No.: 628,537

[22] Filed: Apr. 10, 1996

[30] Foreign Application Priority Data

Apr. 10, 1995 [JP] Japan ..... 7-084256

[51] Int. Cl.[6] ..... B24B 1/00; B24D 5/00

[52] U.S. Cl. ..... 216/88; 216/89; 216/90; 216/99; 264/138; 264/162; 264/340; 264/341; 264/678; 451/41; 451/53

[58] Field of Search ..... 264/138, 67, 340, 264/341, 678, 162; 451/41, 53; 216/88, 89, 90, 99

[56] References Cited

U.S. PATENT DOCUMENTS

| | | | |
|---|---|---|---|
| 5,073,461 | 12/1991 | DeKoven | 428/698 |
| 5,096,854 | 3/1992 | Saito et al. | 437/225 |
| 5,157,876 | 10/1992 | Medellin et al. | 51/281 R |
| 5,196,353 | 3/1993 | Sandhu et al. | 437/8 |
| 5,232,875 | 8/1993 | Tuttle et al. | 437/225 |
| 5,297,365 | 3/1994 | Nishioka et al. | 51/283 |
| 5,305,554 | 4/1994 | Emken et al. | 51/7 |

FOREIGN PATENT DOCUMENTS

| | | |
|---|---|---|
| 61168463 | 7/1986 | Japan . |
| 4115859 | 4/1992 | Japan . |
| 5305561 | 11/1993 | Japan . |
| 6277993 | 10/1994 | Japan . |
| 6278013 | 10/1994 | Japan . |
| 7221058 | 8/1995 | Japan . |
| 7223160 | 8/1995 | Japan . |

OTHER PUBLICATIONS

Abstract of JP 02–337211.
Abstract of JP 02–138,370.
Abstract (only)—English language translation JP 61168463.
Abstract (only)—English language translation JP 4115859.
Abstract (only)—English language translation JP 5305561.
Abstract (only)—English language translation JP 6277993.
Abstract (only)—English language translation JP 6278013.
Abstract (only)—English language translation JP 7221058.
Abstract (only)—English language translation JP 7223160.

*Primary Examiner*—James Derrington
*Attorney, Agent, or Firm*—Lyon & Lyon LLP

[57] ABSTRACT

An abrasive wheel made of an abrasive which is chemically reactive with a ceramic workpiece and a binder mixed with the abrasive is held against the ceramic workpiece at a temperature ranging from 40° C. to 300° C. preferably 100° C. to 180° C., under at least an atmospheric pressure in a moistening atmosphere within a pressure vessel. The abrasive wheel is rotated in abrading contact with the ceramic workpiece. A surface layer of the ceramic workpiece which is held against the abrasive wheel is mechanically abraded and also subjected to a tribochemical reaction with the abrasive wheel, so that the surface layer of the ceramic workpiece can smoothly and neatly be removed from the ceramic workpiece. The ceramic workpiece thus ground is finished highly accurately and efficiently.

12 Claims, 4 Drawing Sheets

METHOD OF AND APPARATUS FOR TRIBOCHEMICALLY FINISHING CERAMIC WORKPIECE

BACKGROUND OF THE INVENTION

1. Field of the Invention

The present invention relates to a method of and an apparatus for tribochemically precision-finishing a ceramic workpiece made of a ceramic material such as silicon nitride ($Si_3N_4$), sialon, silicon carbide (SiC), alumina ($Al_2O_3$), or a composite sintered body.

2. Description of the Prior Art

Ceramic materials such as silicon nitride ($Si_3N_4$), for example, have certain properties better than metallic materials from the standpoint of applications under adverse conditions, e.g., they are more resistant to corrosion, wear, and heat, and harder than metallic materials. Therefore, such ceramic materials are finding wide use as various mechanical parts in severe sliding and rolling conditions, including rolling bearings, sliding bearings, rocker arms, roller followers, among others.

To make a mechanical part of ceramic material, it is necessary to machine a ceramic workpiece into the mechanical part according to a machining process including grinding. One typical grinding process employs a diamond abrasive for grinding a ceramic workpiece. In the grinding process, a surface of the ceramic workpiece which is being ground is heated to a high temperature, tending to suffer residual stresses or having an undesirably heat-damaged surface layer after grinding.

Basically, grinding a ceramic surface with a diamond abrasive is achieved by cutting and ploughing the ceramic surface with the diamond abrasive. Therefore, microcracks tend to be developed in the ground ceramic surface layer, decreasing the mechanical strength thereof.

To solve the above problem, there have heretofore been proposed various improved methods for grinding a ceramic workpiece with a diamond abrasive.

According to a method disclosed in Japanese laid-open patent publication No. 61-68463, a workpiece is ground by a diamond abrasive and then heated to form an oxidized layer thereon. Thereafter, the workpiece is finished to remove the oxidized layer.

Japanese laid-open patent publication No. 4-115859 reveals a method of finishing a workpiece of $Si_3N_4$ with a diamond abrasive. According to the revealed method, the workpiece is ground under such conditions that the temperature at a point of contact between the workpiece and the abrasive is kept at at least a temperature for forming a plastic flow layer on the surface of the workpiece and the relationship between horizontal and vertical components of a resistance to the grinding forces is kept in a predetermined range.

Japanese laid-open patent publication No. 5-305561 shows a method of finishing a workpiece of $Si_3N_4$ with a diamond abrasive by vertically cutting into the workpiece in a predetermined range of speeds and horizontally grinding the workpiece in a predetermined range of speeds.

The proposed grinding methods are addressed to improving various conditions for grinding workpieces with a diamond abrasive, so that the ground workpiece surfaces are prevented from developing damages inherent in the mechanical grinding processes, including microcracking, deformation, and heat-induced damages. However, these problems cannot fully be solved by the prior proposals themselves. The workpiece surfaces that have been ground by the conventional methods need to be finished by lapping, polishing, etc.

One recent different approach, which has increasingly been applied to ceramic surface finishing, is mechanochemical polishing (MCP) that is a combination process of physical machining and chemical reaction between a ceramic workpiece and an abrasive for removing workpiece particles.

However, the presently available mechanochemical polishing process is less efficient than conventional finishing processes which use abrasives of cubic boron nitride (CBN), silicon carbide, or alumina to finish metallic materials.

Another process that has recently drawn much attention in the art as a process for removing a ceramic material at high-temperature and under high-pressure water is a tribochemical reaction.

SUMMARY OF THE INVENTION

It is an object of the present invention to provide a method of and an apparatus for tribochemically finishing a ceramic workpiece made of a ceramic material such as $Si_3N_4$ sialon, SiC, $Al_2O_3$, or a composite sintered body more precisely and efficiently than the conventional mechanochemical polishing process.

According to the present invention, there is provided a method of tribochemically finishing a ceramic workpiece, comprising the steps of holding an abrasive member against a ceramic workpiece at a temperature ranging from 40° C. to 300° C. under at least an atmospheric pressure in a moistening atmosphere, the abrasive member being made of an abrasive which is chemically reactive with the ceramic workpiece and a binder mixed with the abrasive, and moving the abrasive member and the ceramic workpiece relatively to each other to cause a surface layer of the ceramic workpiece which is held against the abrasive member to be mechanically abraded and subjected to a tribochemical reaction with the abrasive member, whereby the surface layer of the ceramic workpiece can be removed.

According to the present invention, there is also provided a method of tribochemically finishing a ceramic workpiece, comprising the step of moving an abrasive member and a ceramic workpiece which are made of mutually chemically reactive materials, respectively, relatively in contact with each other, at a temperature ranging from 40° C. to 300° C. under at least an atmospheric pressure in a moistening atmosphere, whereby a surface layer of the ceramic workpiece which is held against the abrasive wheel can be removed by a tribochemical reaction with the abrasive wheel.

According to the present invention, there is provided an apparatus for tribochemically finishing a ceramic workpiece, comprising a pressure vessel for developing a moistening atmosphere therein under at least an atmospheric pressure, a support jig disposed in the pressure vessel, for supporting a ceramic workpiece, an abrasive member disposed in the pressure vessel for finishing contact with the ceramic workpiece supported by the support jig, the abrasive member being made of an abrasive which is chemically reactive with the ceramic workpiece and a binder mixed with the abrasive, moving means for moving the abrasive member and the ceramic workpiece relatively to each other while the abrasive member is being held against the workpiece supported by the support jig, and heating means for heating the pressure vessel up to a temperature ranging from 40° C. to 300° C.

According to the present invention, there is also provided an apparatus for tribochemically finishing a ceramic workpiece, comprising a pressure vessel for accommodating a ceramic workpiece in a moistening atmosphere therein under at least an atmospheric pressure, an abrasive member disposed in the pressure vessel for finishing contact with the ceramic workpiece, the ceramic workpiece and the abrasive member being made of mutually chemically reactive materials, respectively, means on the pressure vessel for moving the abrasive member and the ceramic workpiece relatively to each other while the abrasive member is being held against the workpiece, and means for heating the pressure vessel up to a temperature ranging from 40° C. to 300° C.

The ceramic workpiece may be made of a material selected from the group consisting of $Si_3N_4$, sialon, and SiC, and the abrasive may be made of a material selected from the group consisting of $Cr_2O_3$, $Fe_2O_3$, $Fe_3O_4$, $SiO_2$, $CeO_2$, $BaCO_3$, $CaCO_3$, $TiO_2$, MgO, and $In_2O_3$. Alternatively, the ceramic work-piece may be made of $A1_2O_3$, and the abrasive may be made of a material selected from the group consisting of $SiO_2$, $Fe_2O_3$, $Fe_3O_4$, $TiO_2$, and MgO.

The moistening atmosphere may comprise water or saturated steam.

The abrasive member may be pressed against the ceramic workpiece while the abrasive member and the ceramic workpiece are being moved relatively to each other.

The abrasive member may be held against the ceramic workpiece at a temperature ranging from 100° C. to 180° C.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
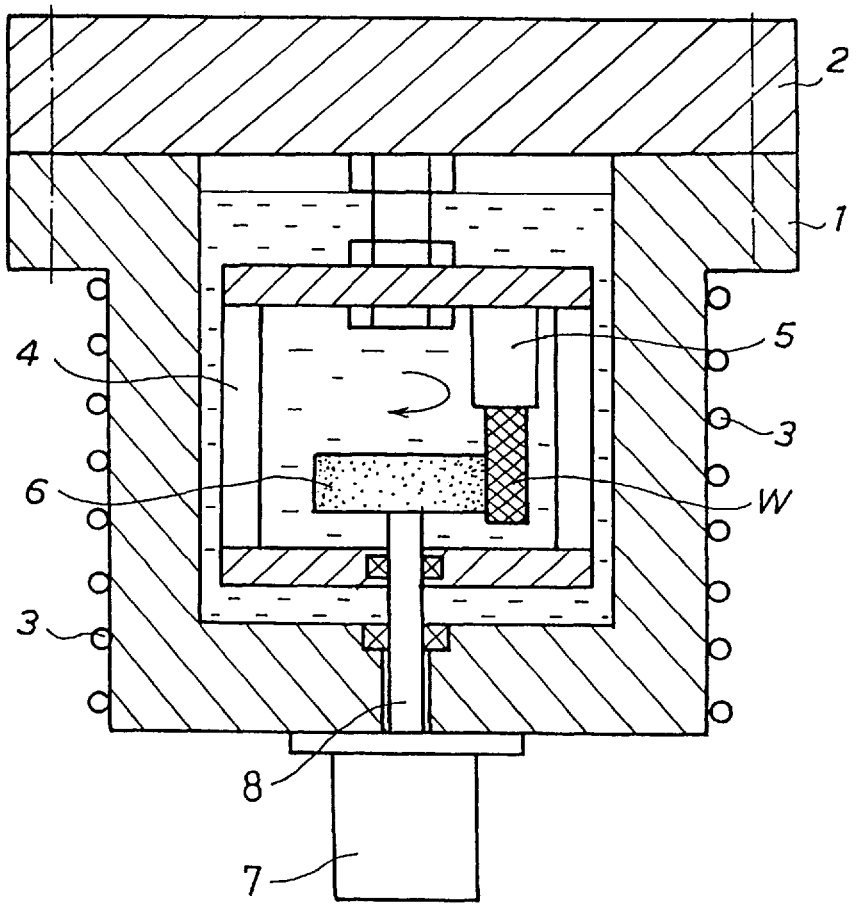
FIG. 1 is a vertical cross-sectional view of an apparatus for tribochemically finishing a ceramic workpiece according to an embodiment of the present invention.

As shown in FIG. 1, an apparatus for tribochemically finishing a ceramic workpiece according to an embodiment of the present invention comprises a pressure vessel 1 in the form of an autoclave, a lid 2 openably mounted on an upper surface of the pressure vessel 1, a heater 3 disposed around the pressure vessel 1, and a support box 4 positioned within the pressure vessel 1.

The pressure vessel 1 is filled with a moistening atmosphere. For example, the pressure vessel 1 should preferably be filled with saturated steam. Alternatively, the pressure vessel 1 may be substantially filled with water, leaving an upper space therein which is filled with air, a nitrogen gas, an inert gas, or the like, so that a two-phase system, i.e., an air-gas system, exists in the pressure vessel

1. The moistening atmosphere may contain an additive or additives which are used in ordinary polishing processes.

The support box 4 has open lateral sides, and houses a support jig 5 for supporting a ceramic workpiece W thereon and an abrasive wheel 6 made of an abrasive which is formed into a wheel shape by being mixed with a binder. The abrasive wheel 6 is mounted on an upper end of a vertical shaft 8 which extends through bottom walls of the support box 4 and the pressure vessel 1 and is connected to an electric motor 7 that is mounted on a lower surface of the bottom wall of the pressure vessel 1. Therefore, the abrasive wheel 6 can be rotated about its own vertical axis by the motor 7 through the vertical shaft 8. The abrasive wheel 6 which is rotated by the motor 7 has its outer circumferential surface held against a vertical side surface of the workpiece W which is supported on and extends downwardly from the support jig 5. The support jig 5 may be rotatably supported by the support box 4 and coupled to an electric motor (not shown) for rotating the support jig 5.

The ceramic workpiece W may be made of a ceramic material such as $Si_3N_4$, sialon, SiC, $Al_2O_3$, or the like. The abrasive of the abrasive wheel 6 may be made of an oxide or a carbonate of a metal or a semimetal, such as $Cr_2O_3$, $Fe_2O_3$, $Fe_3O_4$, $SiO_2$, $CeO_2$, $BaCO_3$, $CaCO_3$, $TiO_2$, MgO, $In_2O_3$, or the like. The binder combined with the abrasive may be a resinoid bond which enables the abrasive wheel 6 to operate as a resinoid wheel for finishing the ceramic workpiece W highly efficiently for excellent surface roughness.

The material of the abrasive should preferably be selected depending on the ceramic material of the ceramic workpiece W for imparting a good finish to the surface of the ceramic workpiece W.

For example, if the workpiece W is made of $Si_3N_4$, sialon, or SiC, then the abrasive material should typically be $Cr_2O_3$ or preferably be $Fe_2O_3$, $Fe_3O_4$, $SiO_2$, $CeO_2$, $BaCO_3$, $CaCO_3$, $TiO_2$, MgO, or $In_2O_3$. If the workpiece W is made of $Al_2O_3$, then the abrasive material should typically be $SiO_2$ or preferably be $Fe_2O_3$, $Fe_3O_4$, $TiO_2$, or MgO.

The tribochemically finishing apparatus shown in FIG. 1 operates as follows:

The ceramic workpiece W to be finished is set on the support jig 5 in contact with the abrasive wheel 6, and the pressure vessel 1 is filled with saturated steam. The interior chamber of the pressure vessel 1 is kept at a temperature ranging from 40° C. to 300° C. and under at least an atmospheric pressure. Such a temperature and a pressure can be achieved by heating the pressure vessel 1 with the heater 3. The abrasive wheel 6 is rotated by the electric motor 7 to finish the ceramic workpiece W. At this time, the workpiece W may be rotated by the support jig 5. The surface layer of the ceramic workpiece W which is held against the rotating abrasive wheel 6 is mechanically abraded, and also subjected to a tribochemical reaction between the ceramic material of the workpiece W and the material of the abrasive of the abrasive wheel 6 under the above temperature and pressure conditions in the presence of the saturate steam. At this time, the abrasive wheel 6 may be pressed against the ceramic workpiece W to accelerate the tribochemical reaction. Specifically, forces tending to press the abrasive wheel 6 against the ceramic workpiece W can be created by relatively positioning the support jig 5 and the abrasive wheel 6 such that the ceramic workpiece W mounted on the support jig 5 physically interferes with the abrasive wheel 6 to the extent required to keep the abrasive wheel 6 pressed against the ceramic workpiece W.

The surface layer of the ceramic workpiece W which is mechanically abraded and also subjected to a tribochemical reaction is smoothly and neatly removed without causing microcracking, deformation, and heat-induced damages to the workpiece W which would otherwise be apt to occur with the conventional grinding process using a diamond abrasive. The rate of removal of the surface layer of the ceramic workpiece W by the mechanical abrasion and the tribochemical reaction is much higher than the rate of removal achieved by the mechanochemical polishing process alone.

The temperature in the pressure vessel 1 is selected to range from 40° C. to 300° C., preferably from 100° C. to 180° C., because the surface layer of the ceramic workpiece W can be finished to a smooth pore-free mild finish within this temperature range. At temperatures below 40° C., any water would not appreciably be present between the contacting surfaces of the abrasive wheel 6 and the ceramic workpiece W. At and above 40° C., water is more likely to exist between those contacting surfaces. At and above 100° C., water is appreciably present between the contacting surfaces of the abrasive wheel 6 and the ceramic workpiece W due to a saturated condition achieved in the pressure vessel 1. The ceramic workpiece W tends to suffer slight corrosion and hence is not finished to a highly neat and smooth surface at temperatures ranging from 180° C. to 300° C. Beyond 300° C., the ceramic workpiece W would be subject to appreciable corrosion and its surface would not be neatly and smoothly finished. Within the temperature range from 40° C. to 300° C., a catalytic oxidation effect is well produced on the ceramic workpiece W while it is being finished by the abrasive wheel 6 for generating a neatly and smoothly finished surface highly efficiently.

The pressure in the pressure vessel 1 is selected to be at least the atmospheric pressure because the atmospheric pressure keeps moisture present between the abrasive wheel 6 and the ceramic workpiece W for promoting the tribochemical reaction. If the pressure in the pressure vessel 1 were lower than the atmospheric pressure, a lack of moisture would likely to occur between the abrasive wheel 6 and the ceramic workpiece W. The pressure vessel 1 is preferably filled with saturated steam because it tends to accelerate the tribochemical reaction as it contains O—H bonds, specifically its molecule has two OH chains and hence high polarity. The saturated steam is preferable in order to maintain as much moisture as possible between the abrasive wheel 6 and the ceramic workpiece W.

Figure 2:
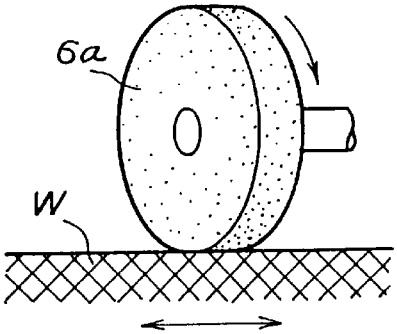
FIGS. 2, 3, 4, and 5 are diagrammatic views of apparatus for tribochemically finishing a ceramic workpiece according to other embodiments of the present invention.

FIG. 2 shows a central portion of an apparatus for tribochemically finishing a ceramic workpiece according to another embodiment of the present invention. In FIG. 2, an abrasive wheel 6*a* which is rotating about its own horizontal axis has its outer circumferential surface held against a ceramic workpiece W which is linearly moving back and forth.

Figure 3:
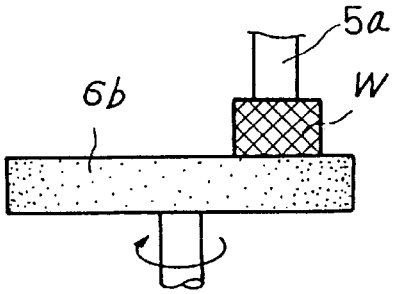

FIG. 3 shows a central portion of an apparatus for tribochemically finishing a ceramic workpiece according to still another embodiment of the present invention. In FIG. 3, a ceramic workpiece W supported on a support jig 5*a* is held against an upper horizontal end surface of an abrasive wheel 6*b* which is rotating about its own vertical axis.

Figure 4:
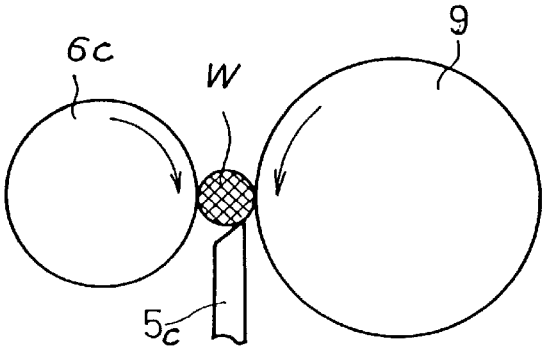

FIG. 4 shows a central portion of an apparatus for tribochemically finishing a ceramic workpiece according to yet still another embodiment of the present invention. In FIG. 4, a workpiece W supported on a support jig 5*c* is sandwiched between and held against an abrasive wheel 6*c* and an adjusting wheel 9 which are rotating about their own axes.

Figure 5:
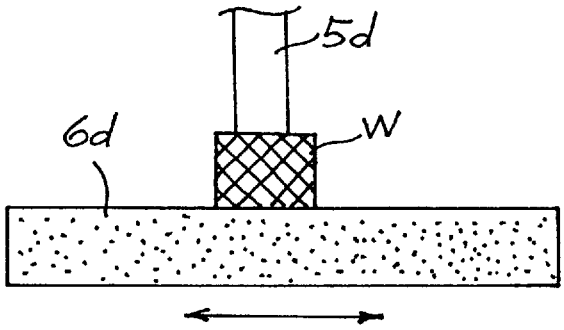

FIG. 5 shows a central portion of an apparatus for tribochemically finishing a ceramic workpiece according to a further embodiment of the present invention. In FIG. 5, a ceramic workpiece W supported on a support jig 5*d* is held against an abrasive body 6*d* which is being reciprocally moved linearly.

Other mechanisms which are available in the art of finishing for moving the workpiece W and the abrasive wheel relatively to each other may be employed in the apparatus according to the present invention. Furthermore, oscillation or vibration used in a superfinishing process may be applied to the workpiece W, the abrasive wheel 6, or both for finishing the workpiece W with increased precision and efficiency.

Figure 6:
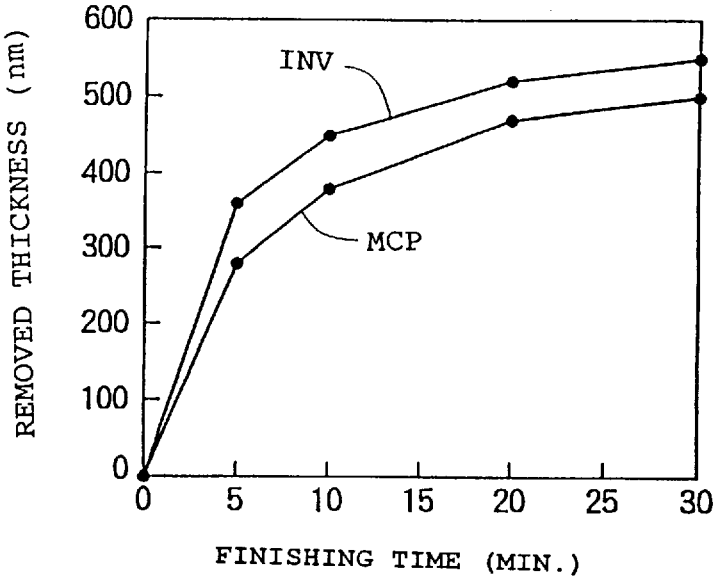
FIG. 6 is a graph showing the relationship between the finishing time and the thickness of workpiece layers that are removed by inventive and conventional methods.
Figure 7:
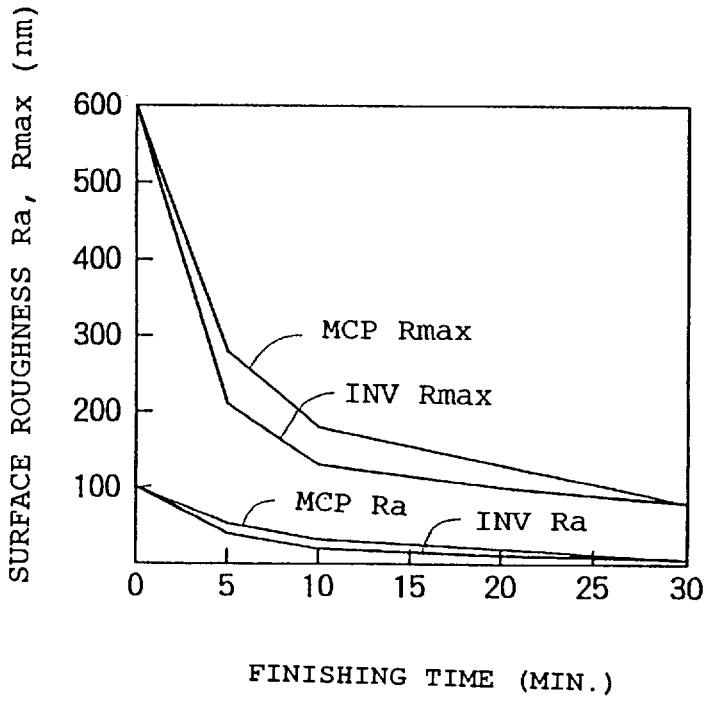
FIG. 7 is a graph showing the relationship between the finishing time and the surface roughness of workpiece surfaces that are ground by inventive and conventional methods.

FIG. 6 shows the relationship between the finishing time and the thickness of workpiece layers that are removed by inventive and conventional methods, and FIG. 7 shows the relationship between the finishing time and the surface roughness Rmax (maximum), Ra (average) (JIS B0601) of workpiece surfaces that are ground by inventive and conventional methods. The results shown in FIGS. 6 and 7 were obtained under the experimental conditions given below.

A. Inventive method

A testing machine with a cylindrical finishing apparatus installed in a pressure vessel was employed. A ceramic workpiece to be ground was placed in the cylindrical finishing apparatus, and distilled water was poured into the pressure vessel, leaving an upper space therein. After the pressure vessel was closed, it was heated up to 150° C., and the ceramic workpiece was finished by an abrasive wheel of the cylindrical finishing apparatus. During the test, the pressure of saturated steam was present in the pressure vessel. Detailed conditions of the test are as follows:

Abrasive wheel

Average particle diameter of $Cr_2O_3$: 0.5 $\mu$m

Surface roughness: #10,000

Abrasive concentration: 80~90%

Dimensions: Width of 35 mm and diameter of 79.6 mm

Finishing conditions

Pressing load on the workpiece: 190N

Abrasive wheel rotational speed: 100 m/min. (about 400 rpm)

Workpiece rotational speed: 45 m/min. (about 1300 rpm)

Temperature: 150° C.

Pressure: 4.718 atm.

Environment: Underwater

B. Conventional mechanochemical polishing method

The same abrasive wheel as the abrasive wheel used in the inventive method was used. The same pressing load as the pressing load in the inventive method was applied to a workpiece. The abrasive wheel and the workpiece were rotated at the same speeds as those in the inventive method. The abrasive wheel and the workpiece were kept at a room temperature of 25° C. and under an atmospheric pressure. While the workpiece was being grounded by the abrasive wheel, water was dropped as a finishing solution onto the abrasive wheel at a rate of 300 ml/min.

It can be seen from FIG. 6 that the finishing rate is higher with the inventive tribochemical finishing method than with the conventional mechanochemical polishing method. It can also be understood from FIG. 7 that the time required to achieve a desired surface roughness of the ground surface is shorter with the inventive tribochemical finishing method than with the conventional mechanochemical polishing method.

Although certain preferred embodiments of the present invention have been shown and described in detail, it should be understood that various changes and modifications may be made therein without departing from the scope of the appended claims.

What is claimed is:

1. A method of tribochemically finishing a ceramic workpiece, comprising the steps of:

holding an abrasive member against a ceramic workpiece at a temperature ranging from 100° C. to 180° C. under at least an atmospheric pressure in a moistening atmosphere, said abrasive member being made of an abrasive which is chemically reactive with the ceramic workpiece and a binder mixed with the abrasive; and moving said abrasive member and said ceramic workpiece relatively to each other to cause a surface layer of said ceramic workpiece which is held against said abrasive member to be mechanically abraded and subjected to a tribochemical reaction with the abrasive member, whereby said surface layer of said ceramic workpiece can be removed.

2. A method according to claim 1, wherein said ceramic workpiece is made of a material selected from the group consisting of $Si_3N_4$, sialon, and SiC, and said abrasive is made of a material selected from the group consisting of $Cr_2O_3$, $Fe_2O_3$, $Fe_3O_4$, $SiO_2$, $CeO_2$, $BaCO_3$, $CaCO_3$, $TiO_2$, MgO, and $In_2O_3$.

3. A method according to claim 1, wherein said ceramic workpiece is made of $Al_2O_3$, and said abrasive is made of a material selected from the group consisting of $SiO_2$, $Fe_2O_3$, $Fe_3O_4$, $TiO_2$, and MgO.

4. A method according to claim 1, wherein said moistening atmosphere comprises water.

5. A method according to claim 1, wherein said moistening atmosphere comprises saturated steam.

6. A method according to claim 1, further comprising the step of pressing said abrasive member against said ceramic workpiece while said abrasive member and said ceramic workpiece are being moved relatively to each other.

7. A method of tribochemically finishing a ceramic workpiece, comprising the step of:

moving an abrasive wheel and a ceramic workpiece which are made of mutually chemically reactive materials, respectively, relatively in contact with each other, at a temperature ranging from 100° C. to 180° C. under at least an atmospheric pressure in a moistening atmosphere, whereby a surface layer of said ceramic workpiece which is held against said abrasive wheel can be removed by a tribochemical reaction with the abrasive wheel.

8. A method according to claim 7, wherein the material of said ceramic workpiece is selected from the group consisting of $Si_3N_4$, sialon, and SiC, and the material of said abrasive member is selected from the group consisting of $Cr_2O_3$, $Fe_2O_3$, $Fe_3O_4$, $SiO_2$, $CeO_2$, $BaCO_3$, $CaCO_3$, $TiO_2$, MgO, and $In_2O_3$.

9. A method according to claim 7, wherein the material of said ceramic workpiece is $Al_2O_3$, and the material of said abrasive member is selected from the group consisting of $SiO_2$, $Fe_2O_3$, $Fe_3O_4$, $TiO_2$, and MgO.

10. A method according to claim 7, wherein said moistening atmosphere comprises water.

11. A method according to claim 7, wherein said moistening atmosphere comprises saturated steam.

12. A method according to claim 7, further comprising the step of pressing said abrasive wheel against said ceramic workpiece while said abrasive wheel and said ceramic workpiece are being moved relatively to each other.

* * * * *